US005953810A

United States Patent [19]

Goodhart et al.

[11] Patent Number: 5,953,810

[45] **Date of Patent: *Sep. 21, 1999**

[54] WEATHERPROOFING FOR SHEET METAL ROOFING

[75] Inventors: Robert R. Goodhart, New Cumberland, W. Va.; Paula J. Costantini, Steubenville, Ohio; Ray A. Benesh, Bellaire, Ohio; James A. Orr, Martins Ferry, Ohio

[73] Assignee: Weirton Steel Corporation, Weirton, W. Va.

[ * ] Notice: This patent is subject to a terminal disclaimer.

[21] Appl. No.: 08/912,725

[22] Filed: Aug. 18, 1997

Related U.S. Application Data

[60] Continuation-in-part of application No. 08/588,021, Jan. 17, 1996, Pat. No. 5,657,603, which is a division of application No. 08/225,326, Apr. 8, 1994, Pat. No. 5,495,654.

[51] Int. Cl.[6] ..... B23P 13/04

[52] U.S. Cl. ..... 29/557; 52/518

[58] Field of Search ..... 29/428, 527.4, 29/460, 557; 52/518, 529, 530, 531

[56] References Cited

U.S. PATENT DOCUMENTS 5,495,654 3/1996 Goodhart et al. ..... 29/527.4

*Primary Examiner*—David P. Bryant
*Attorney, Agent, or Firm*—Shanley and Baker

[57] ABSTRACT

Combinations of inorganic corrosion-protection, passivating chemical treatment, and selected organic-type coatings of flat-rolled mild steel of selected thickness gauge and mechanical properties, provide for fabrication of composite-coated unitary sheet metal structures for lightweight and durable roof covering. Weathertight features with provisions for subsurface air circulation, free of liquid from precipitation, are provided by fabricating interfitting slot configurations on four linear sides of a viewable tab portion. Methods of fabrication provide for ease of assembly while providing configurations which compensate for barriers to entry of liquids where linearly-extending slots interfit during horizontally-extended assembly, and provide a horizontally-oriented appearance for viewable tab portions throughout a horizontally-extended assembly of unitary flat-rolled sheet metal roof covering structures.

4 Claims, 12 Drawing Sheets

WEATHERPROOFING FOR SHEET METAL ROOFING

RELATED APPLICATION

This application is a continuation-in-part of co-owned and U.S. patent application No. 08/588,021, filed Jan. 17, 1996, entitled "Sheet Metal Roofing Shingle Structures" (now U.S. Pat. No. 5,657,603 issued Aug. 19, 1997) which is a division of U.S. patent application No. 08/225,326 filed Apr. 8, 1994 entitled "Preparing Sheet Metal and Fabricated Roofing Shingles" (now U.S. Pat. No. 5,495,654 issued Mar. 5, 1996).

INTRODUCTION

The present invention relates to sheet metal roofing; and, more particularly, is concerned with preparing composite-coated flat-rolled mild steel and fabricating unitary roof covering structures which contribute lightweight, durable and weathertight roof protection.

SUMMARY OF THE INVENTION

Preparation of flat-rolled steel substrate includes selecting thickness gauge, developing mechanical properties for desired strength while enabling fabrication, surface corrosion protection, and can include embossing and decorative coating prior to fabrication into unitary roof covering structures. Such selection, preparation and fabrication provides:

i. for ease of roofing assembly, ii. resistance to surface corrosion, iii. an interfitting arrangement which resists subsurface entry of liquids from climatic precipitation, along with iv. a tortuous path for subsurface circulation of air which is free of liquids from climatic precipitation, and V. a rigid high-strength roofing assembly with provisions for reception of accessories which enhance installation or roof operating efficiency.

The above and other advantages and contributions are considered in more detail during the description of specific embodiments of the invention, presented with references to the accompanying drawings.

DETAILED DESCRIPTION

Figure 1:
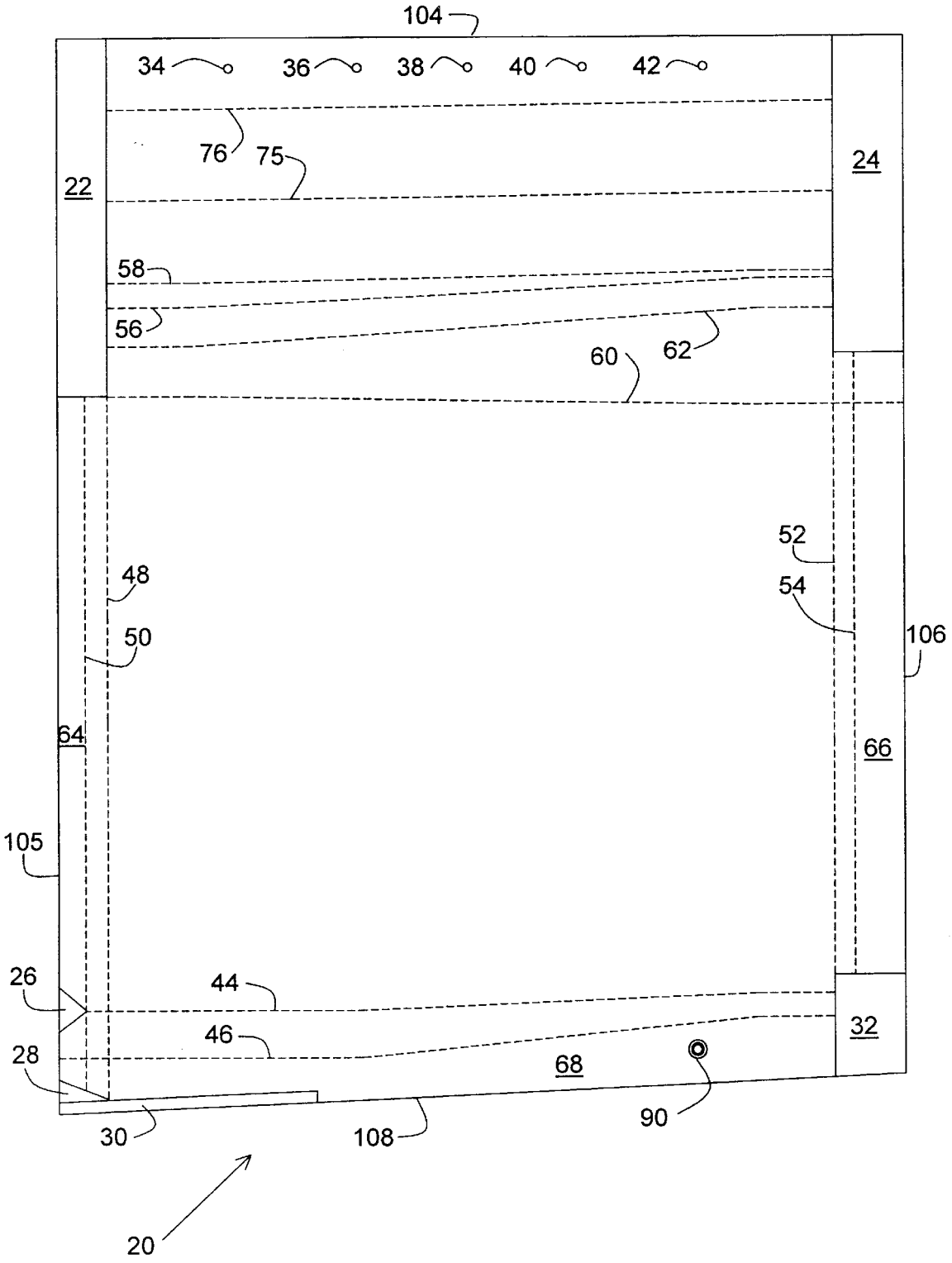
FIG. 1 is an outer-surface plan view of a unitary blank, as cut from continuous strip after being prepared to provide surface protection and desired mechanical properties, and showing line markings for carrying out fabrication of a unitary roof covering structure of the invention.

Sheet metal of prepared thickness gauge and mechanical properties for fabricating unitary roof covering structures is composite-coated. Blanking, cutting and folding steps of the invention contribute interfitting slots which are weathertight and easily assembled; and the interfitting slots, as fabricated and assembled, provide for subsurface air circulation while creating a barrier to subsurface entry of liquids from climatic precipitation.

The unitary roof covering structures of the invention can be fabricated to present a single viewable "tab" (which is often referred to as the "shingle" after roofing is installed), or as unitary panels each providing the appearance of a plurality of individual tabs (or shingles). Such panels are joined and interfitted along four linear edges of the panel, in the same manner as a single viewable "tab" embodiment of the invention is interfitted, and each provides the same weathertight features.

Flat-rolled mild steel is selected in a thickness gauge range of about 0.01" to about 0.03" for economy, impact-resistance, and control of tensile strength and ductility for embossing and fabrication. Such steel is selectively work-hardened by cold-rolling to provide desired tensile strength and hardness while maintaining desired fabricating properties.

Surface coatings are selected which protect against surface corrosion so as to maintain structural integrity and to maintain surface appearance characteristics over extended time periods. Significant reductions in roofing weight, when compared to commercially available asphalt roofing materials, are provided; for example, the weight of a square (10 ft.×10 ft.) using the invention with 0.020" thickness gauge steel (0.020") is approximately 113 pounds; whereas, a "three tab—25 year guarantee" asphalt-based roof covering for such a square has a weight of approximately 238 pounds.

Inorganic corrosion protection for the flat-rolled steel surface is selected from the group consisting of aluminum, copper, hot-dipped tin/zinc alloys, hot-dipped galvanized (including Galfan® and Galvalume®, available from Weirton Steel Corp., Weirton, W.Va. 26062), Tin Mill coatings such as electrolytic tin, zinc, TFS or chrome-oxide, and metal coatings applied to mild steel by particulate metal-spray coating, as disclosed in copending and co-owned U.S. patent application (Ser. No. 60/053/787), filed Jul. 25, 1997, entitled "Metal Spray-Coated Flat-Rolled Mild Steel And Its Manufacture."

Chemical passivating treatment of flat-rolled steel surface, or of a coating metal surface, is selectively carried out to enhance adhesion of a paint or polymeric finish which is selected for decorative and color purposes for certain of the corrosion-protective metal coatings. Polymeric coating application methods are selected from the group consisting of polymers in a solvent carrier, solid polymers applied as a powder or laminate, extruded polymers, or other suitable methods for applying a substantially uniform thickness polymer coat to corrosion-protected flat-rolled steel.

Embossing of the sheet metal, or at least an exposed "tab" portion, of a unitary roof covering structure of the invention helps to compensate for temperature-related expansion and contraction of the flat-rolled steel substrate. Acceptable embossed appearance features are shown in co-owned and copending U.S. Design patent applications Ser. Nos. 29/067,466 and 29/067,465, filed Mar. 4, 1997, which are incorporated herein by reference; however, the present invention is not limited to those embossing designs.

Unitary sheet metal blanks for a single viewable tab embodiment, or for a panel embodiment with the appearance of multiple individual tabs, can be cut from continuous strip composite-coated flat-rolled steel. To facilitate fabrication, selective embossing and a limited number of steps (as indicated in the fabrication process) can be carried out while the sheet metal is in continuous-strip form.

In the above and following description of roof covering structures of the invention, directional references, such as vertical or horizontal, find their basis in relation to directions for making an installation, along an inclined support surface for receiving a roof covering. Unitary roof covering structures of the invention are located side-by-side to form a horizontally-oriented course; and, such courses are assembled, one above the other, in a vertical direction, from rain gutter level of such inclined surface toward the apex (or "ridge") thereof. Such directional orientations are also used in describing the unitary roof covering structures of the invention.

Unitary sheet metal blank 20 of FIG. 1 has a generally rectangular configuration along its upper perimeter, with a trapezoidal configuration along its lower perimeter. Use of that trapezoidal configuration enables the roof covering structures to be fabricated to provide barriers to entry of liquid from climatic precipitation, and to provide for interfitting in a manner such that viewable portions (single "tab" or multiple tabs in a panel) of such structures present a horizontal appearance in an assembled roof.

Assembly of horizontally-oriented courses is shown and described from left to right. Provision for assembly in the opposite direction (right to left) can be provided based on present teachings. The lateral sides of a unitary roof covering structure are fabricated to be parallel to each other.

In order to prevent access of subsurface liquid, an added fold-over layer of sheet metal is located to act as a barrier to liquid entry at the distal ends of horizontally-extending slots. Also, air access is provided, as described in more detail later herein.

During fabrication, those portions of unitary blank 20 which are to be cut away are shown as solid lines in FIG. 1; and locations for folding over of sheet metal are indicated by interrupted lines. At the latter locations, the sheet metal is folded over to form linearly-extended slotted openings (slots), contiguous to each linear dimension of a generally rectangular viewable tab, for interfitting roof covering structures with adjacent roof covering structures located both horizontally and vertically.

In FIG. 1, right-angle corner portions 22, 24, near the upper portion of the blank are outlined in solid lines and are cut away. Angled sections 26, 28, at the lower left portion of the blank, lower edge section 30, and trapezoidally-shaped corner portion 32, shown in solid lines, are also cut away. Further, apertures 34–42, near the upper edge of the blank, are formed prior to folding over sheet metal during fabrication of a unitary roof covering structure.

Cutting away steps, forming of such apertures, and selective embossing can be carried out while composite-coated flat rolled steel is in continuous-strip form, which facilitates fabrication of production quantities.

The trapezoidal configuration is introduced along the lower edge of unitary blank 20 of FIG. 1; and, has its effect above that perimeter.

Dimensions of a specific embodiment of the invention, included below, contribute to the description and understanding of functions achieved by use of the trapezoidal shape.

Vertically-adjacent interrupted lines, which are shown in pairs in FIG. 1, provide for folding over of sheet metal during fabrication to form an elongated slot which is accessible along its opening for interfitting with a slot of an adjacent structure during assembly. After folding over of sheet metal along such pairs of interrupted lines, to form a slot, the closed end of the slot has a substantially semicircular, or arcuate, shape in cross section. As located, that semicircular shape helps to define the portion of the unitary structure, referred to as the viewable tab portion, which remains in view after assembly.

Such pairs of interrupted lines are indicated as 44 and 46 (near the bottom edge of blank 20), 48 and 50 (near the left edge of the blank), 52 and 54 (near the right edge); with 56, 58, 60 and 62 located in an area approaching the upper portion of blank 20.

Figure 2:
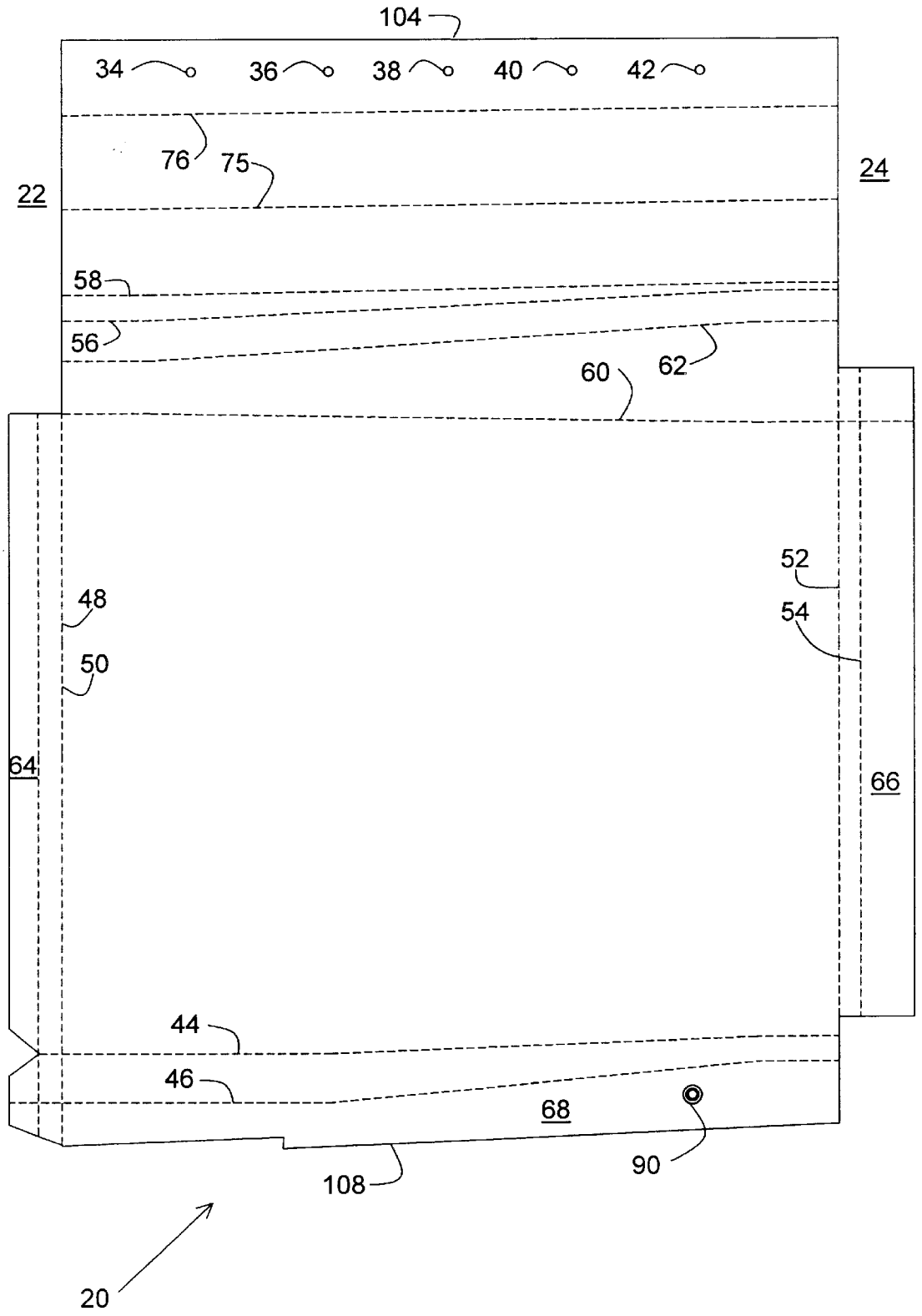
FIG. 2 is a plan view of the embodiment of FIG. 1 for describing cutting away portions of such blank in accordance with the invention.
Figure 3:
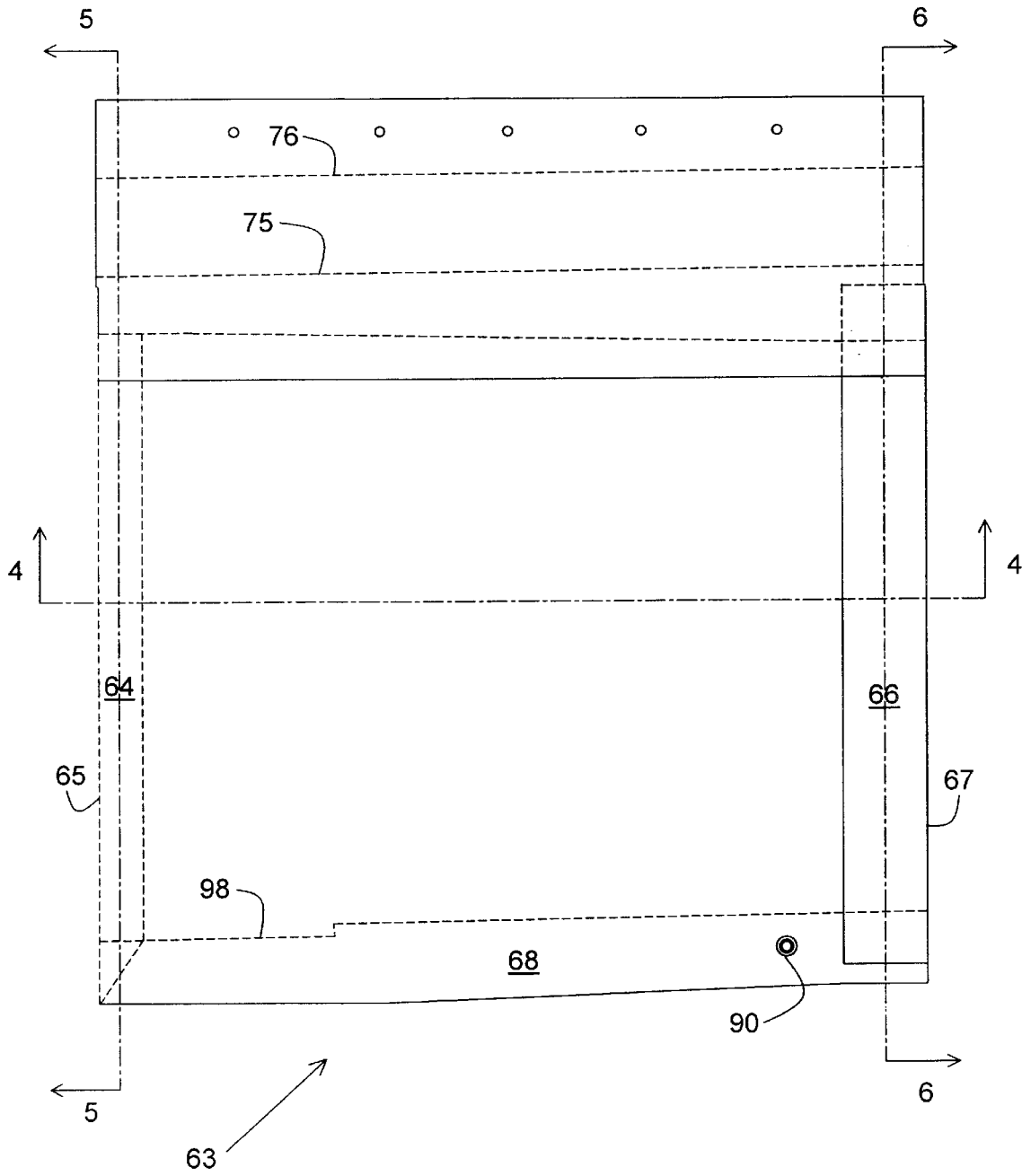
FIG. 3 is an outer-surface plan view of a roof covering structure fabricated in accordance with the invention.

Unitary blank 20, with cut-away sections removed, is shown in FIG. 2; interrupted lines remain as they were shown in FIG. 1. Roof covering structure 63 of the invention, as it appears subsequent to cutting away of such portions and subsequent to folding over of sheet metal to form slots for interfitting with other such structures, is shown in FIG. 3. FIGS. 1–3 are plan views of the outer surface of the blank and fabricated structure. A single viewable tab embodiment is shown and described initially; details of that fabrication are applicable to structures having a panel configuration, as later shown, in which the viewable portions present a plurality of tabs; and, Table I dimensions refer to such a panel embodiment.

Folding over of sheet metal to form lateral edge slots is first carried out along vertically-oriented fold lines 48–50 and 52–54 (FIGS. 1 and 2). Section 64 (along the left edge of roof covering structure 63 of FIG. 3) is folded-over so as to be substantially parallel with the plane of remaining sheet metal of unitary blank 20; and, is positioned on the underside of such remaining sheet metal blank. The metal, which had been between interrupted lines 48 and 50 (FIG. 1) after folding over of section 64, has a semicircular cross-sectional shape which connects subsurface section 64 with the remaining sheet metal roof covering structure 63 and comprises the closed end of the otherwise open linearly-extended slot, and has a mid-point which defines one lateral side (65, FIG. 3) of the viewable tab portion of the unitary structure 63. The orientation of such folded-over section 64 is better seen in FIG. 4, which is an enlarged cross-sectional view taken at line 4—4 of FIG. 3.

Section 66 (near the right edge of blank 20 in FIGS. 1 and 2) is folded-over so as to be substantially parallel with the plane of remaining sheet metal of the blank; and, is positioned on the outer surface edge of the roof covering structure being fabricated. The section between interrupted lines 52 and 54 of FIGS. 1 and 2 is fabricated with a semicircular cross-sectional shape, connecting planar section 66 with the remaining roof covering structure. Folded-over section 66 is located at the opposite lateral edge with respect to section 64, as shown in cross section in FIG. 4, and mid-point 67, FIG. 3, defining the lateral side of the viewable tab portion at that location.

Figure 4:
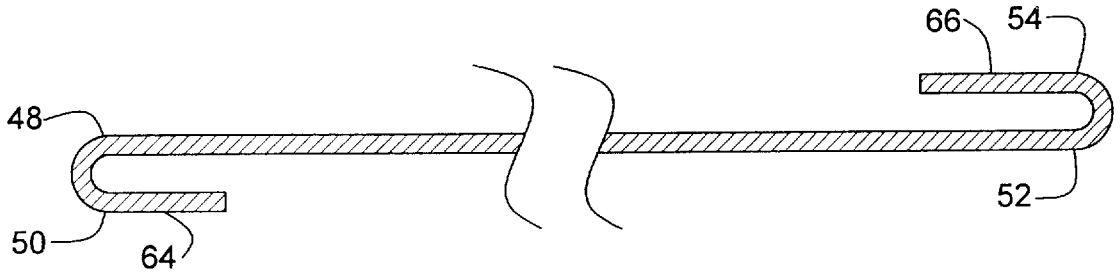
FIG. 4 is an enlarged cross-sectional view, taken along line 4—4 of FIG. 3, for describing folding over sheet metal portions forming vertically-extending slots for interfitting roof covering structures along lateral sides of a viewable "tab" portion of those structures, during assembly of a horizontally-oriented course in accordance with the invention.

Reference points designated 48, 50 and 52, 54 in FIG. 4 refer, respectively, to the locations where interrupted lines 48, 50 and 52, 54 were located in FIGS. 1 and 2. Folded-over sections 64, 66 establish linearly-extended slots along the lateral edges of roof covering structure 63, which provide for interfitting of horizontally-adjacent roof covering structures of the invention as those structures are assembled along a horizontally-oriented course. The relative movement between roof covering structures, for purposes of interfitting those slots during assembly, is considered later and described in more detail.

Folding over of sheet metal along remaining pairs of interrupted lines, shown in FIGS. 1 and 2, comprises a second stage of the fabrication which differs from the fabrication of the vertically-disposed folded-over sections 64 and 66 of FIG. 4. The latter are uniformly-spaced from the main body of the unitary structure along each such linearly-extended lateral slot, as indicated by the cross-sectional view of FIG. 4.

The trapezoidal configuration is utilized in forming slots which extend horizontally and which are located at the upper and lower perimeter of the viewable tab. Those slots result from folding over sheet metal at pairs of interrupted lines (44, 46 and 56, 58 of FIGS. 1 and 2). Those pairs of interrupted lines have substantially parallel portions only at locations contiguous to their distal ends. An intermediate portion, between those distal ends, is transitional and can have varying cross-sectional geometry.

The substantially uniform cross-sectional geometry established near each such distal end provides for nested interlocking of slots of adjacent roof covering structures at those ends. Also, an added thickness of folded-over sheet metal is made at those locations to provide a barrier to entry of precipital liquids. Compensation for that added folded-over sheet metal, as taught herein, avoids a stepped relationship between adjacent roof covering structures along a horizontally-oriented course, which would otherwise be cumulative; and, provides a substantially horizontal presentation for viewable tabs along the length of the course.

Figure 5:
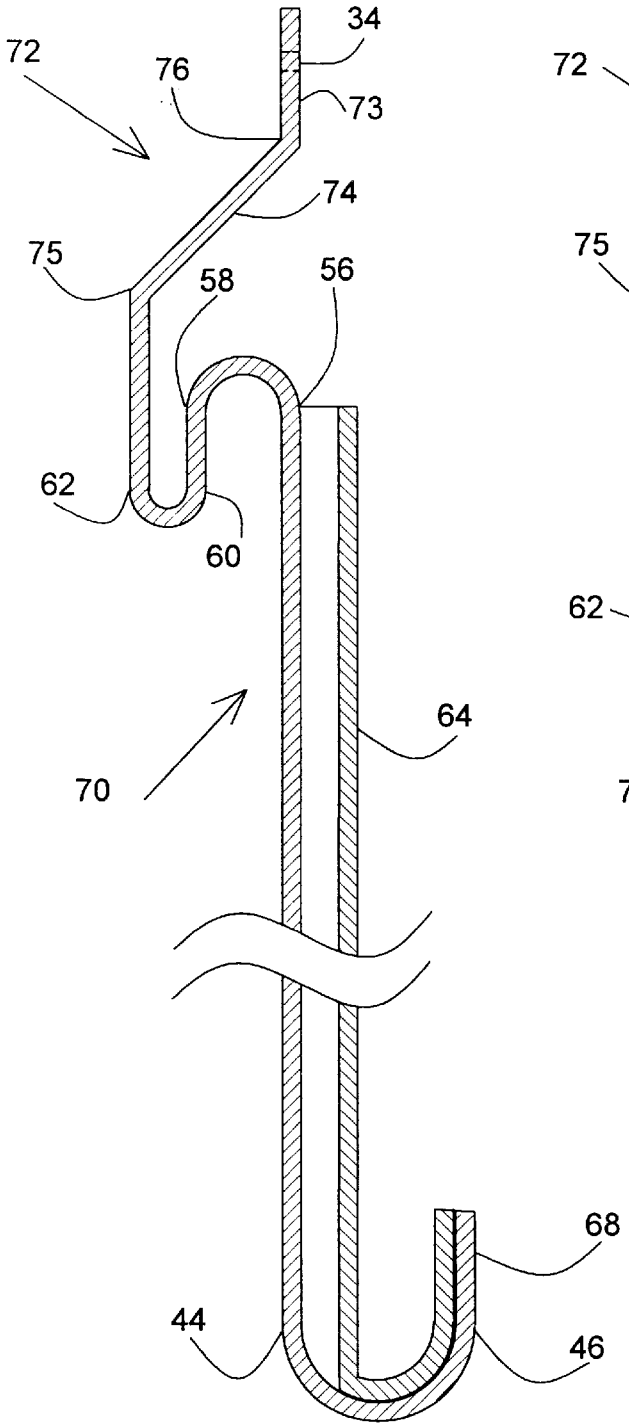
FIG. 5 is an enlarged cross-sectional view for describing folded-over sheet metal portions forming interfitting slots, which extend horizontally above and below a viewable "tab" portion and are used for vertical direction assembly and horizontal alignment of unitary roof covering structures of the invention, such view being taken along line 5—5 of FIG. 3.
Figure 6:
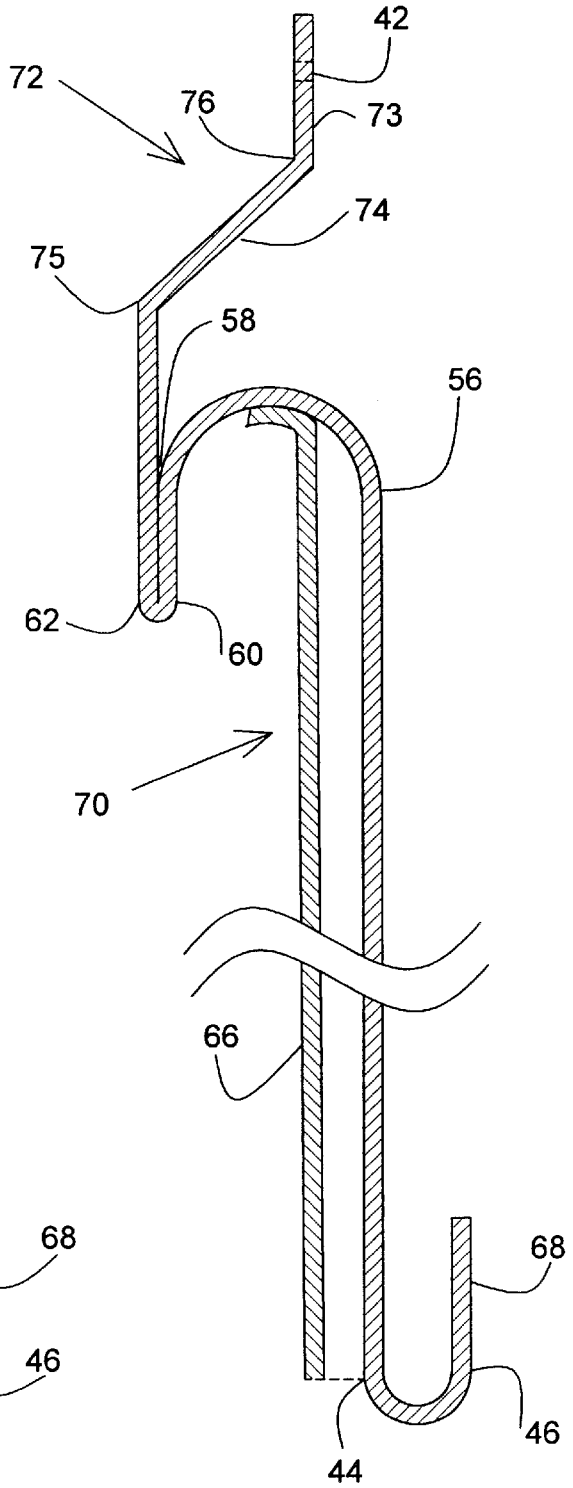
FIG. 6 is an enlarged cross-sectional view of such interfitting slots of FIG. 5, as shown along line 6—6 of FIG. 3.

The differing cross-sectional dimensional relationship (geometry), in approaching each distal end of the upper and lower horizontally-extending slots, is shown in FIGS. 5 and 6. The dimensional relationship of the slot near one distal end is presented in FIG. 5; and a substantially uniform width portion at the opposite distal end is shown in FIG. 6. A cross-sectional dimensional transition exists intermediate those two locations which are taken at 5—5 and 6—6, respectively, of FIG. 3.

The length of the substantially uniform geometry near each distal end of the slots provides for ease of assembly, as the adjacent unitary roof covering structures must slide in relation to each other in making a lateral edge interfitting (described in relation to FIGS. 10 and 11) as such covers are assembled along a horizontal course.

Section 68, along the lower edge at unitary blank 20 of FIGS. 1 and 2, is folded over so as to be substantially parallel with the plane of the remaining shingle structure blank and to have a position on the undersurface of the remaining blank. A cross-sectional view of folded-over section 68, along the lower perimeter of the viewable tab, as taken at a location indicated by line 5—5 in FIG. 3, is shown in FIG. 5; and a cross-sectional view of section 68, as viewed at a location indicated by line 6—6 of FIG. 3, is shown in FIG. 6.

Reference points 44 and 46 in FIGS. 5 and 6 represent lines 44 and 46, respectively, of FIGS. 1–2. The difference in slot cross-sectional geometry, dimension, in each of the substantially uniform slot width portions at each distal end of such lower perimeter slot, is also indicated by the differing dimensions between lines 44 and 46 in the views of FIGS. 1 and 2.

The differing slot widths near distal ends, as lines 44 and 46 become near parallel, make sliding assembly easier in assembling a horizontally-oriented course while providing a rigid and weathertight fit with improved nesting at those distal ends; the near parallel relationship at those distal ends is also shown by the data in Table 1.

Upper horizontally-extending interfitting slots are also formed by folding over multiple sheet metal layers along two pairs of interrupted lines, 56, 58 and 60, 62, respectively, of FIGS. 1–2. The cross-sectional dimensional relationship of those upper horizontally-extending slots near their distal ends are also shown in the enlarged cross-sectional views of FIGS. 5 and 6. The pairs of fold lines are referenced by points 56, 58, and 60, 62, respectively, in those FIGS. The substantially uniform cross-sectional dimensional relationship (geometry) established near distal end portions helps to provide for ease of sliding movement sliding for interfitting of lateral edge slots mentioned earlier.

Such upper multiple-layer slots (formed by folding over sheet metal at 56, 58 and 60, 62) separate the unitary structure 63 into: (i) a viewable tab portion 70 (FIGS. 5 and 6) which, after assembly, remains exposed and visible, and (ii) an upper lapped portion 72 which is overlapped and not visible after assembly. Portion 72 is covered by tab portion 70 of a next vertically-adjacent roof covering structure. Embossed or contoured portions, as disclosed in co-owned, copending design patent applications referenced above, can be limited to such viewable portion (70) where a deep embossing pattern would not interfere with folding over of sheet metal or with interfitting of slots. However, a shallow embossing pattern (depth between about 0.005" to about 0.01") can be carried out on the entire surface of the blank, before stamping or cutting the roof covering structure, and has certain advantages.

Apertures 34–42, for placement of fasteners, are located in top edge section 73 of covered portion 72. An offset 74 is formed in covered portion 72 by bending the metal at interrupted bend lines 75 and 76 of FIGS. 1–2 (which also appear as reference points 75 and 76 of FIGS. 5 and 6). The angled relationship of the sheet metal between 75 and 76 allows the full fastener section 73 to contact the understructure support for securing the unitary roof covering structure in place, by nailing or other fastening means, while angled offset 74 provides for absorbing forces which may be encountered during assembly which otherwise could tend to distort such a unitary structure as secured by fastener means.

Figure 7:
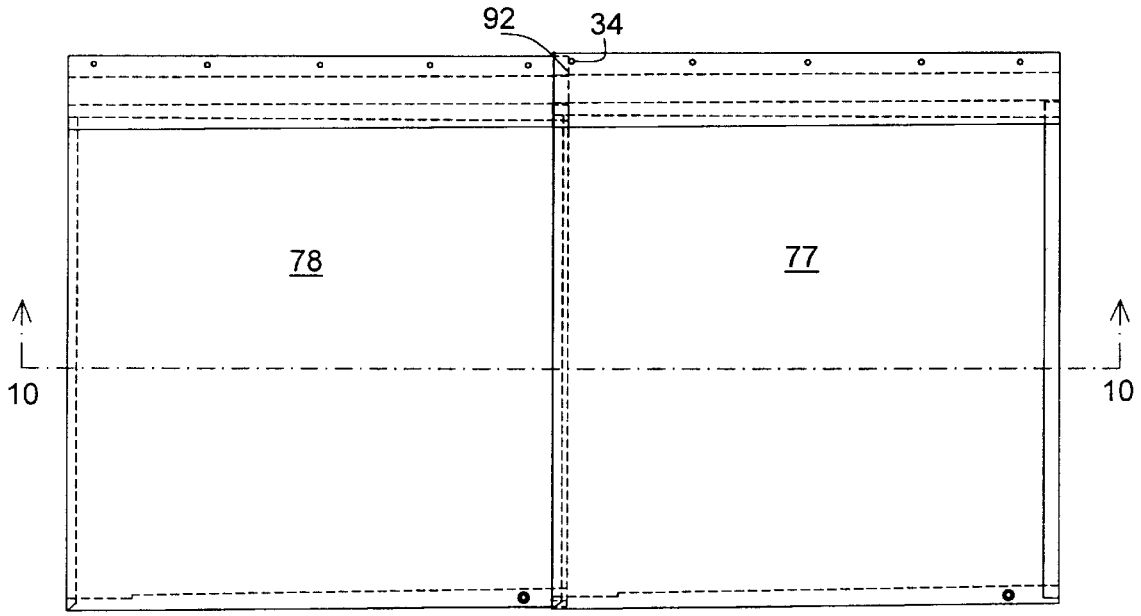
FIG. 7 is an outer-surface plan view of a pair of unitary roof covering structures of the invention for describing a side-by-side interlocking relationship of such structures along a horizontally-oriented course.

Assembly proceeds in the direction from left to right along a horizontally-oriented course in FIG. 7. A left lateral edge slot of roof covering structure 77 is interfitted in the right lateral edge slot of roof covering structure 78 (reference is also made to FIG. 4 and later FIGS. 10. 11). Structure 78, which has been at least partially fastened to supporting understructure, receives the left lateral edge (section 64 of FIG. 4) by relative sliding movement of unitary roof covering structure 77 as the two unitary structures are assembled in side-by-side relationship as shown in the general arrangement view of FIG. 7.

Figure 8:
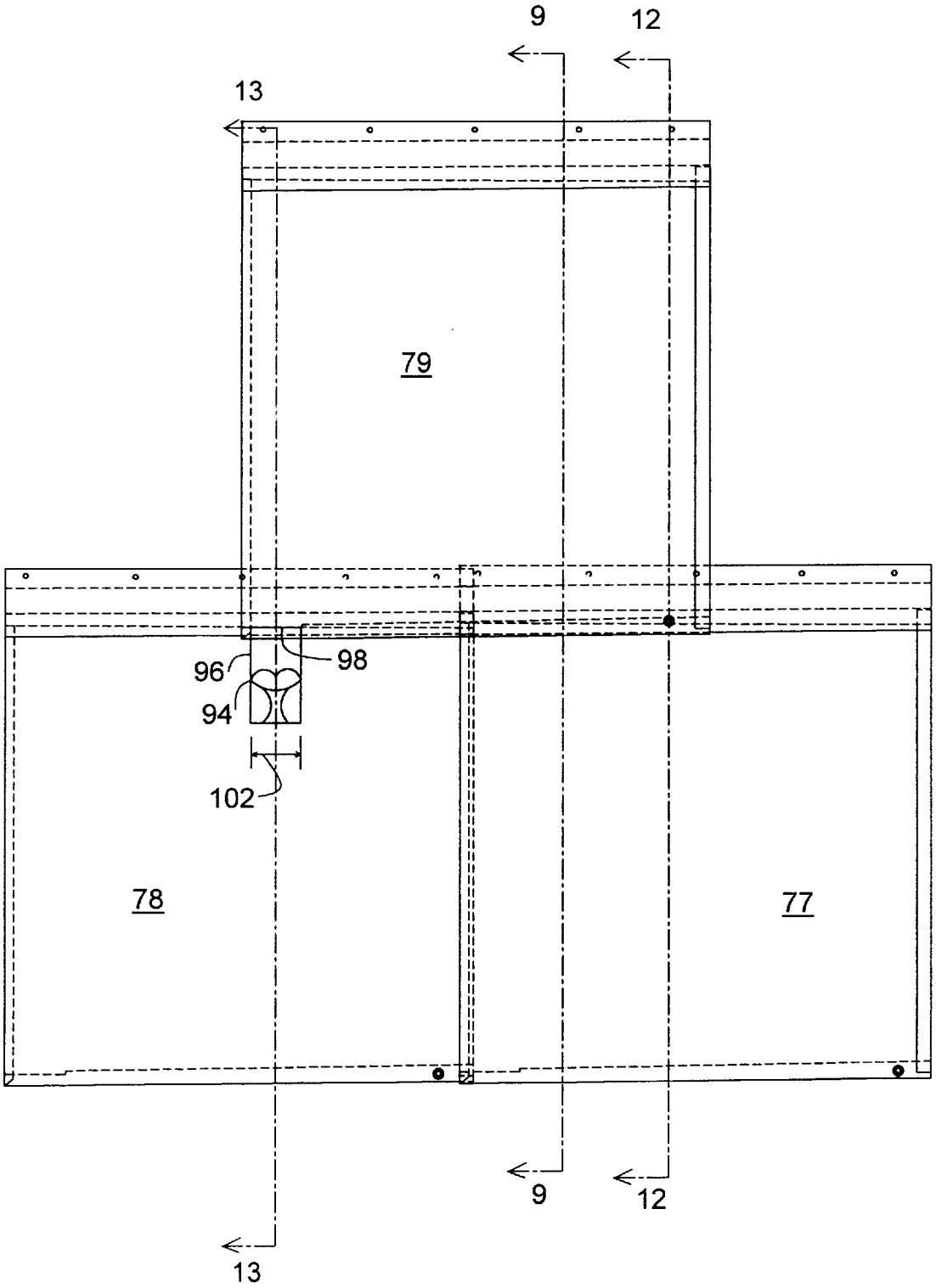
FIG. 8 is an outer-surface plan view for depicting a staggered relationship of interfitting edge portions during assembly of a second course of roof covering structures, located next-adjacent vertically of the horizontally-oriented course of FIG. 7, in accordance with the invention.
Figure 9:
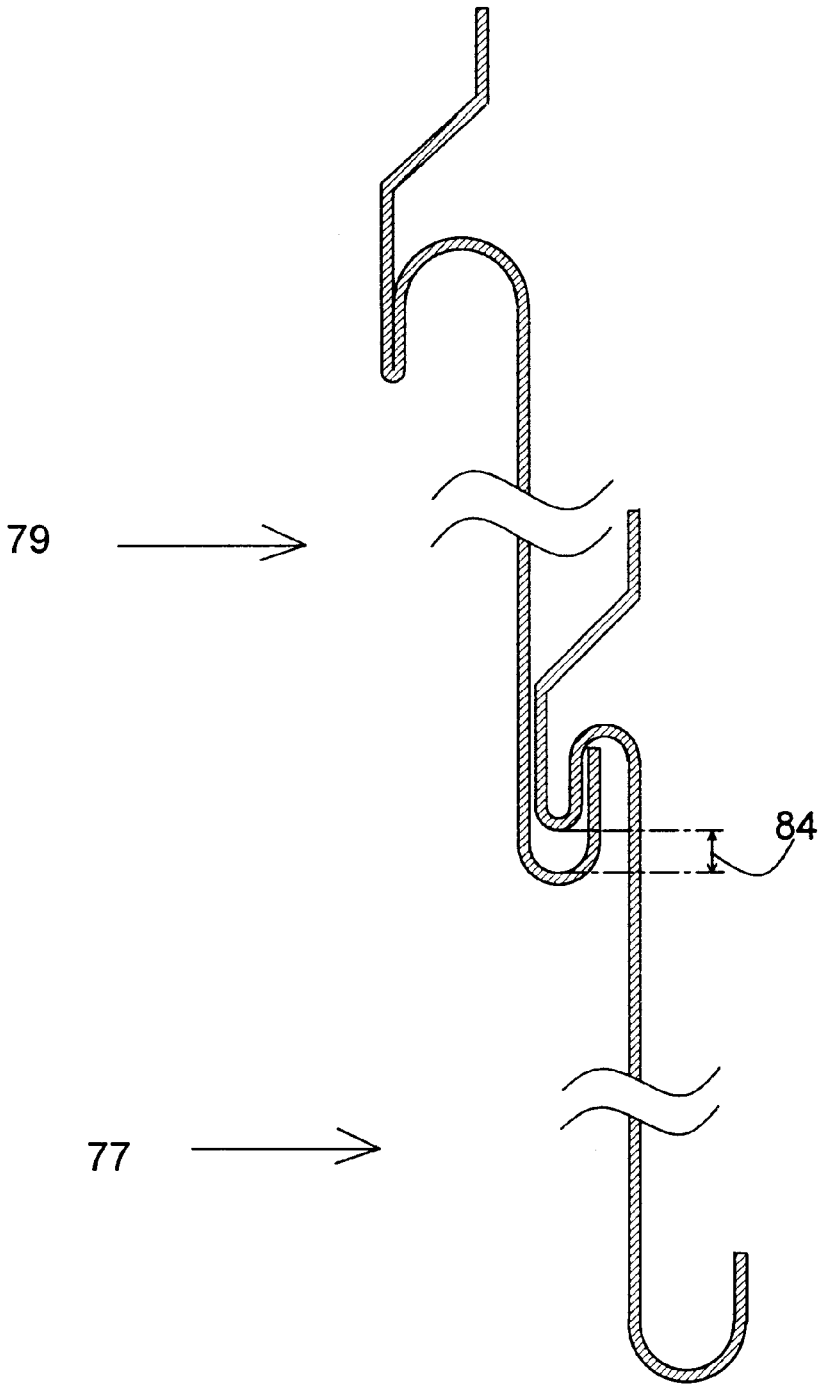
FIG. 9 is an enlarged cross-sectional view, taken along the line 9—9 of FIG. 8, for describing interfitting assembly of a pair of such unitary structures, positioned in vertically-adjacent relationship, in accordance with the invention.

After completion or partial completion of a horizontally-oriented course, a new course, vertically above the first course, can be initiated, as shown in general arrangement view of FIG. 8, and in the enlarged cross-sectional view of FIG. 9. Structure 79 for such a new course is placed in staggered relationship to the vertically-oriented lateral edge slots of FIG. 7. The staggered location is at approximately one-half the horizontally-oriented dimension of the next vertically adjacent roof covering structure. Such staggered placement, indicated by FIG. 8, continues throughout each new vertically-located course.

Figure 10:
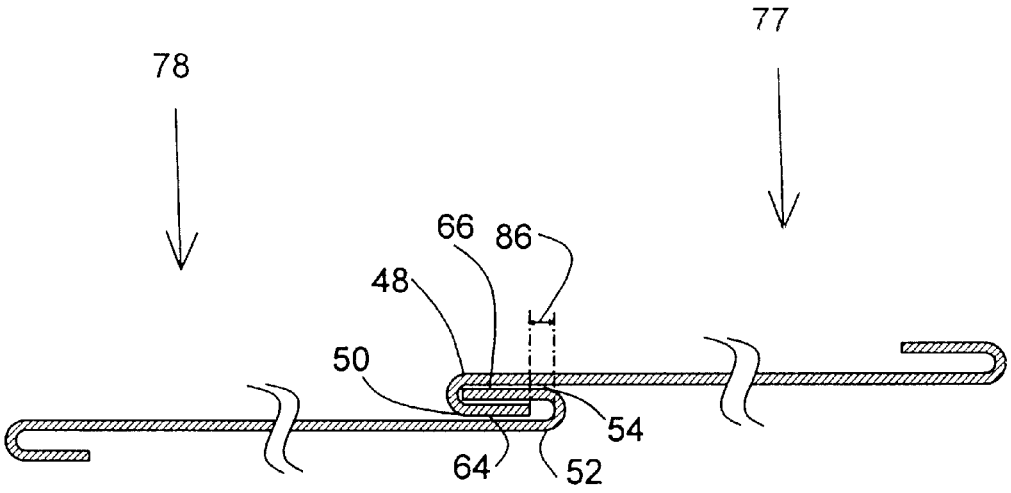
FIG. 10 is an enlarged cross-sectional partial view, taken along line 10—10 of FIG. 7, for describing interfitting lateral edges of a pair of such unitary structures, as assembled along a horizontally-oriented course, in accordance with the invention.

Referring to FIGS. 9–12, FIG. 9, an enlarged cross-sectional partial view taken along line 9—9 of FIG. 8, and FIG. 10, a cross-sectional partial view taken along line 10—10 of FIG. 7, show the interfitting relationships carried out as roof covering structures are being assembled. The horizontally-extending sheet metal slots are interfitted vertically resulting in the orientation of FIG. 9. The vertically-oriented lateral edge slots (FIG. 10) are interfitted by relative sliding movement in a horizontal direction.

Figure 11:
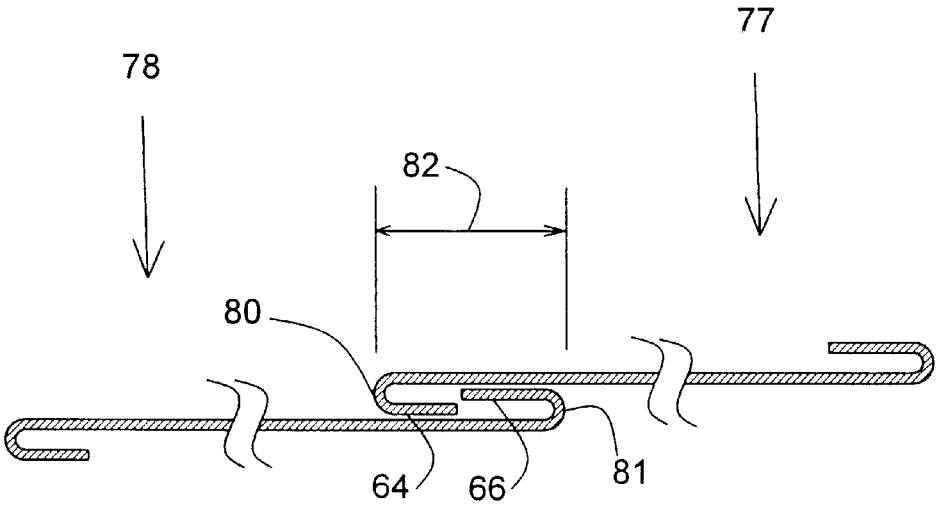
FIG. 11 is an enlarged cross-sectional partial view of such pair of unitary roof covering structures approaching such interfitting, shown in FIG. 10, for describing dimensional provisions made during fabrication for ease of assembly in accordance with the invention.
Figure 12:
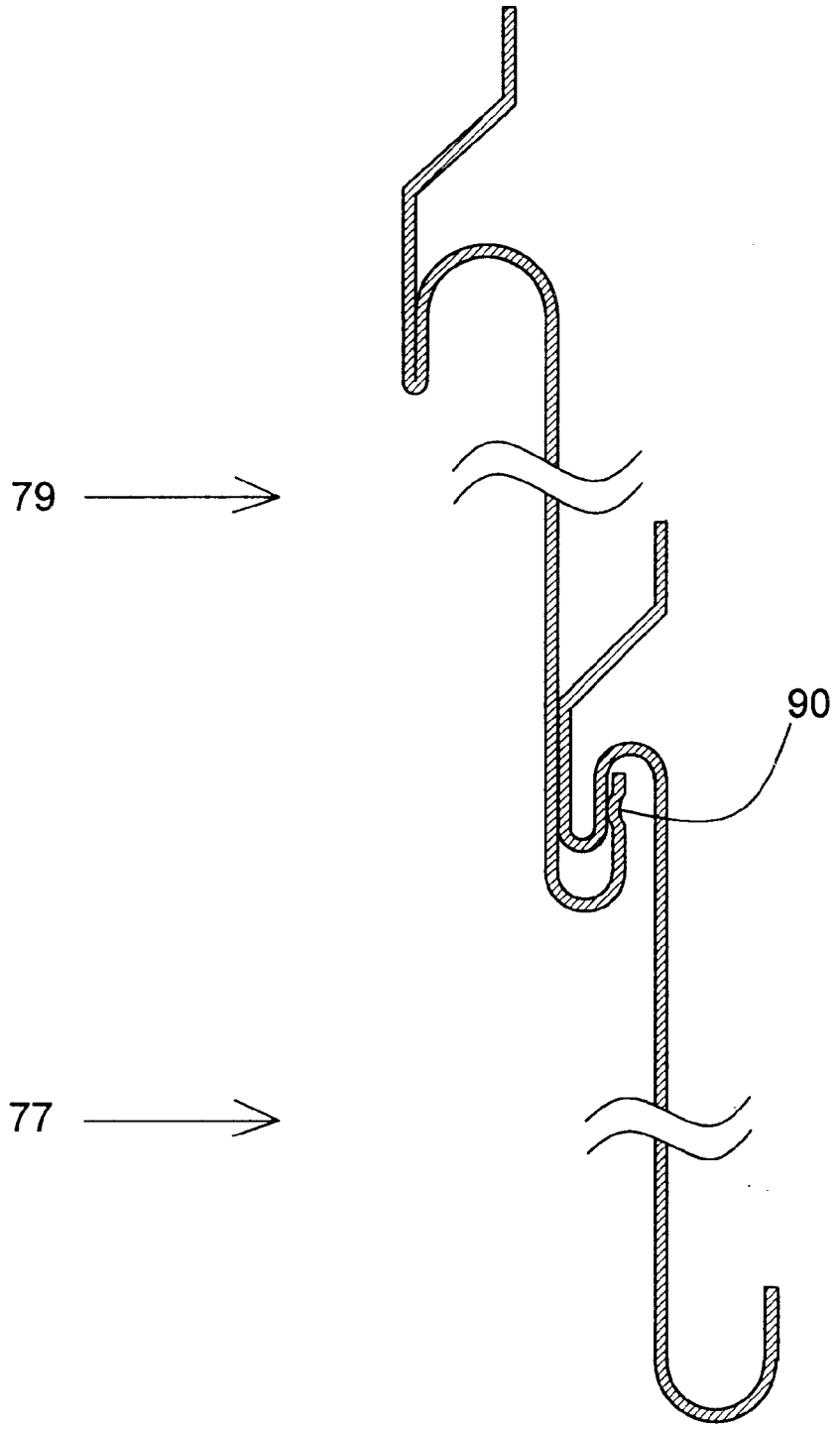
FIG. 12 is a cross-sectional view of a pair of such unitary roof covering structures, taken along the line 12—12 of FIG. 8, for describing a feature of the invention which facilitates desired assembly of those structures, in accordance with the invention.

The roof covering structure 77 being placed in FIG. 7 must be able to move laterally to provide an interfitting relationship of each vertical lateral edge slot of the two unitary structures (77, 78). That relative movement is determined by the amount of sliding movement necessary for interfitting the vertically-oriented sections 64 and 66, as shown in FIG. 10. The total distance provided for ease of assembly, shown at 82 in FIG. 11, equals the sum of the distance between:

i. an edge of section 64 and a mid-point of the semicircular fold between interrupted lines 48 and 50 (indicated at 80 in FIG. 11), and ii. an edge of section 66 and a mid-point of the semicircular fold between interrupted lines 52 and 54 (indicated at 81 in FIG. 11).

To provide for ease of alignment and interfitting relative movement of roof covering structures, portions of the horizontally-extending slots, near each distal end, are made with a uniform cross-sectional dimensional relationship (geometry) approximately equal to dimension 82 indicated in FIG. 11. In general, the enlarged dimensional relationship at the left distal end of the unitary structures (FIG. 5) extends substantially the full length of the transition zone intermediate both uniform cross-sectional distal ends.

The interfitting configurations of slot means allow movement of air, but prevent subsurface access by precipitation liquid. The configuration of the added folded sheet metal near each distal end of the horizontally-extending slots prevents siphoning of water which could otherwise take place through metal surfaces positioned in closely spaced relationship. Air gaps are indicated in FIGS. 9 and 10 at 84 and 86, respectively. A separation gap of about 0.125" prevents such siphoning of liquids. Dimensional relationships are tabulated below for a specific embodiment in Table I.

Additional features which assist in obtaining the desired configuration of sheet metal folds for forming interlocking slots include a triangular-shaped cut-out section 26, shown in FIGS. 1 and 2, and selecting dimensions for section 66 relative to fold lines 60 and 62. Cutting away of over-layered sheet metal at distal ends of the horizontally-extending slots prevents buckling of the metal. Such buckling could result in an irregular arc shape at a slot fold which could prevent proper interfitting and nesting. In the selected embodiment of Table I, cut-out section 26 has a 90° angle at its intersection with fold line 44. For the same buckling-prevention reason, the barrier layer of sheet metal at the right distal end of the upper horizontally-extending slot need only extend about ninety degrees (90°) into the closed arcuate end of the slot at that location; that is, about half-way between reference points 56 and 58 of FIG. 6.

Another feature of the invention provides for temporarily holding a roof covering structure in position, during assembly, until fastener means are in place for securing the roof covering to the understructure. Such holding function utilizes at least one detent, located in roof covering structure section 68, near the right lateral edge of the unitary structure, as shown at 90 of FIGS. 1–3, 7–8, and in cross-sectional view in FIG. 12. Such detent restricts the width of the slot at a selected area and temporarily positions a unitary structure, being added to a course, until fastener means are in place.

An aid for alignment of roof covering structures in a course, during assembly, enables sighting the right lateral edge of an assembled shingle through an aperture which is strategically located in a unitary roof covering structure being added to a course. Such edge positioning at a boundary of such aperture is shown at aperture 34 in FIG. 7; in such figure, the edge which is sighted is designated 92.

In a preferred method of the invention, fasteners presenting a threaded shaft are used for securing roof covering structures to a roof support surface. Sizing of such fasteners provides a root diameter for the fastener which is substantially equal to the diameter of the apertures; such a size relationship increases protection against high wind forces.

In an additional feature, a provision is made in interfitting horizontally-oriented folded-over metal for insertion of support means for roofing accessories such as snow guards, or for roof jacks used for support of equipment used during roof covering. A cut-out section, 30 of FIG. 1, provides clearance required for insertion of sheet metal for roofing accessories or support means.

Figure 13:
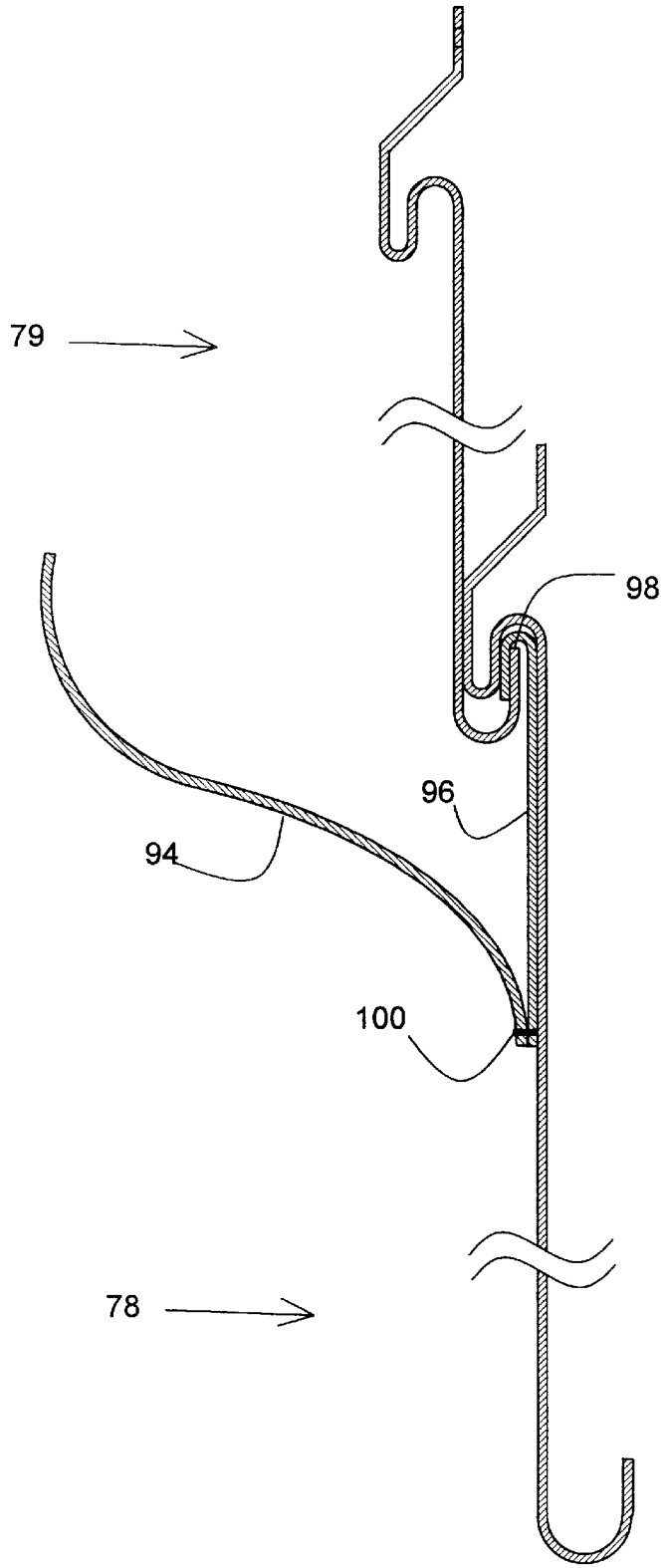
FIG. 13 is a cross-sectional view of such pair of unitary structures, taken along the line 13—13 of FIG. 8, for describing vertical assembly of roof covering structures and provisions for attaching accessories in accordance with the invention.
Figure 14:
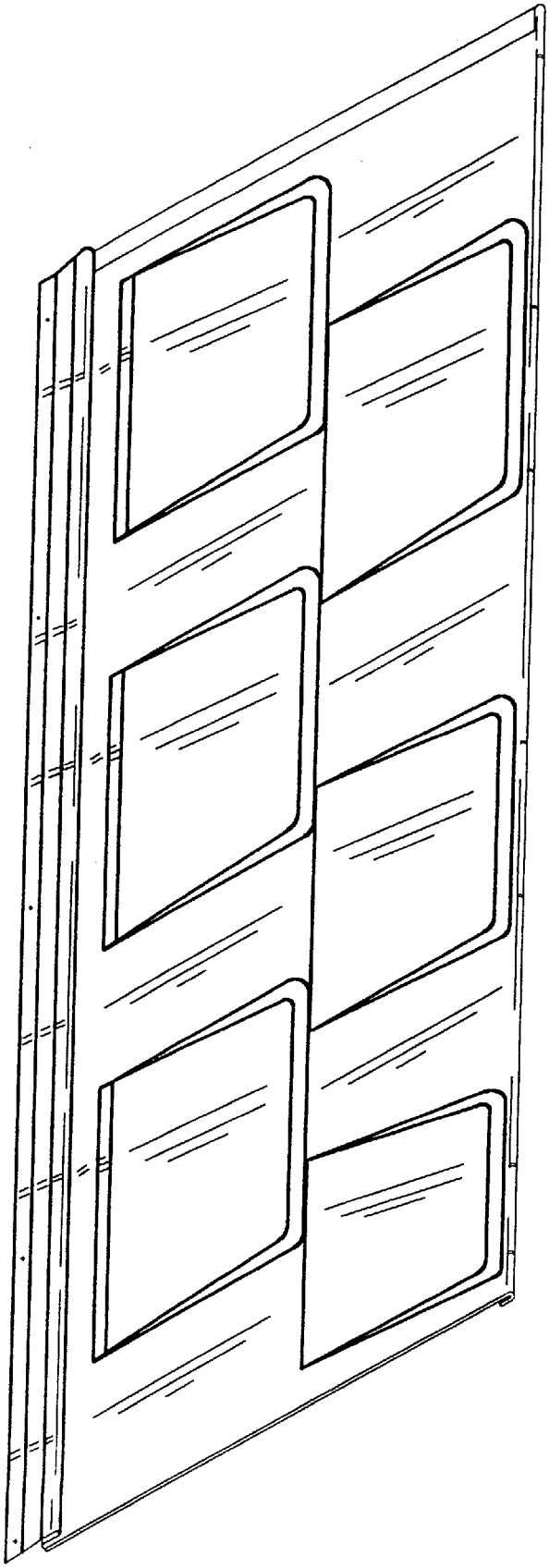
FIG. 14 is a perspective view of a unitary roof covering structure of the invention in the form of a panel in which the viewable portion presents the appearance of a plurality of individual "tabs" or shingles.

Snow guard 94 is shown installed at such lower horizontally-extended slot in the cross-sectional view of FIG. 13. Such cross-sectional view is taken along line 13–13 of FIG. 8. Support arm means 96, for snow guard 94, is interfitted between the lower folded-over sheet metal by inserting its U-shaped upper portion over offset edge 98, as indicated in FIG. 13. The snow guard 94 is connected to support means 96 by fastener means 100. Such support means can be utilized for other roofing accessories, or installation equipment, and can vary in width (indicated at 102 of FIG. 8) to provide desired support strength. When used for support of equipment used for installation, such as roof jacks, the support means width dimension can extend twelve inches or more. Such support means width dimension determines the horizontal dimensions of cut-out section 30 (FIG. 1). Such section is formed with a dimension extending centrally of the structure along its bottom edge, which is at least equal to the width of the support means, and provides clearance for the thickness gauge of the sheet metal of support 96.

In addition, the cross-sectional configuration of the lower folded-over section (defined by fold lines 44 and 46), at the left of the unitary structure, extends toward the opposite distal end of the slot a distance which provides for support 96, and that cross-sectional dimensional geometry can extend to the uniform width portion between lines 44 and 46 of FIG. 6.

An important contribution of the invention takes into consideration the thickness of folded-over liquid barrier metal distal end slot means. Without alignment features of the invention, the cumulative effect of those sheet metal barriers (twice coated metal thickness gauge for each assembled unitary roof covering structure) would distort the orientation of the viewable tabs along a horizontally-oriented course. The appearance of non-alignment of viewable tab portions would be accentuated by the length of the course. The use of the trapezoidal configuration fold lines, described above, maintains a horizontal appearance for the viewable tabs.

In a specific embodiment of the trapezoidal configuration, top edge 104 (FIGS. 1 and 2) is perpendicular to mutually parallel lateral edges 105 and 106. However, bottom edge 108 is angled in relation to such parallel lateral edges, and lateral edge 105 is longer than lateral edge 106. The folding over of sheet metal, as described, takes advantage of that trapezoidal configuration such that the assembled roof covering structures present a substantially horizontal orientation for the viewable portions of the roof covering structures along a horizontally-oriented course, and such viewable portions appear substantially rectangular in shape.

TABLE I

| Specific Embodiment of Sheet Metal Roof Panel Structure | |
|---|---|
| Material | |
| Sheet Metal Material | .023" galvanized steel |
| Sheet Metal Coating | .0016" polymer |
| Sheet Metal Embossing | .009" depth texture |
| Dimensions of Blank (FIG. 1) | |
| Top Edge (104) | 37.302" |
| Bottom Edge (108) | 37.303" |
| Left Edge (105) | 16.326" |
| Right Edge (106) | 16.032" |
| Diameter of Apertures | 0.156" |
| Center of Apertures from Top Edge | 0.284" |
| Section 22 (horizontal × vertical) | 0.391" × 2.771" |
| Section 24 (horizontal × vertical) | 0.561" × 2.458" |
| Section 32 (horizontal × vertical) | 0.561" × 0.822" |
| Section 30 (horizontal × vertical) | 12.00" × 0.050" |

TABLE I-continued

| Specific Embodiment of Sheet Metal Roof Panel Structure | |
|---|---|
| Section 28 (length, angle) | 0.391", 60° 22' |
| Section 26 (angle at fold line 44) | 90° |
| Location of Fold Lines (Distance From Top Edge 104, FIG. 1) | |
| Line 76 | Left 0.560" |
| | Right 0.48" |
| Line 75 | Left 1.25" |
| | Right 1.18" |
| Line 58 | Left 1.903" |
| | Right 1.813" |
| Line 56 | Left 2.099" |
| | Right 1.843" |
| Line 62 | Left 2.402" |
| | Right 2.079" |
| Line 60 | Left 2.771" |
| | Right 2.838" |
| Line 44 | Left 15.551" |
| | Right 15.399" |
| Line 46 | Left 15.904" |
| | Right 15.577" |
| Location of Vertically-Oriented Fold Lines Near Left Lateral Edge (Distance From Edge 105, FIG. 1) | |
| Line 50 | 0.226" |
| Line 48 | 0.391" |
| Location of Vertically-oriented Fold Lines Near Right Lateral Edge (Distance From Edge 106, FIG. 1) | |
| Line 54 | 0.396" |
| Line 52 | 0.561" |

For purposes of disclosing concepts of the invention dimensional data, geometrical relationships and materials of specific embodiments have been described; and, it should be recognized that, in the light of the above description, changes in those specifics can be made while relying on the concepts taught; therefore, in construing the scope of the present invention, reference should be made to the appended claims.

We claim:

1. Method for fabricating a unitary sheet metal roof covering structure, comprising the steps of:

(a) providing corrosion-protected flat-rolled mild steel of preselected thickness gauge, mechanical properties and surface characteristics;

(b) cutting such sheet metal into a unitary blank for fabricating a unitary roofing shingle structure having:

a horizontally-directed axis extending in a direction which is substantially coincident with assembling a plurality of such roof covering structures, in side-by-side interfitting relationship, in a substantially horizontal direction for covering a roof, and a vertically-directed axis in substantially right-angled relationship to such horizontally-directed axis and extending in a direction in which unitary structures are assembled in overlapping relationship for covering a roof;

(c) designating portions of the unitary blank to be cut away, portions to be bent along bend lines, and portions to be folded-over to form slot means;

(d) cutting away designated portions of the unitary blank;

(e) folding over sheet metal at designated vertically-oriented fold lines to provide slots for weathertight interfitting of vertically-oriented slots along lateral edges of horizontally adjacent roof covering structures, each such slot having an elongated open end and an elongated closed end, with such closed end having a semicircular cross-sectional shape;

(f) folding over sheet metal at designated horizontally-oriented fold lines of such blank to provide elongated slots for weathertight interfitting of vertically-adjacent structures, each such slot having an elongated open end and an elongated closed end, with such closed end having a semicircular cross-sectional shape, and (g) bending sheet metal at designated bend lines within such covered portion to provide an apertured section for securing such structure to supporting understructure, and an offset section between such fastening section and the remainder of such roof covering structure for absorbing forces applied during assembly to a secured unitary structure without distorting that secured roof covering structure.

2. The method of claim 1, in which each such vertically-oriented lateral edge slot presents a uniform cross-sectional configuration along its length, and each such horizontally-oriented slot, extending between lateral edges of such structure, presents a cross-sectional dimensional relationship means at a location intermediate lateral edges of such structure, and such cross-sectional dimensional relationship, contiguous to each lateral edge, is uniform along a length selected from each lateral edge to provide for ease of interfitting of lateral edge slots of horizontally-adjacent roof covering structures during assembly.

3. The method of claim 2, in which a plurality of such unitary structures are fabricated from continuous-length corrosion-protected flat-rolled mild steel, and selected bending and cutting away steps are carried out while such steel is in continuous length form.

4. The method of claim 2, in which such unitary blank is cut to have a trapezoidal configuration along its lower peripheral edge.

* * * * *